United States Patent [19]

Pasic et al.

[11] 4,120,239

[45] Oct. 17, 1978

[54] STRAPPING MACHINE

[75] Inventors: James A. Pasic; Marvin I. Berg, both of Montesano, Wash.

[73] Assignee: Ovalstrapping, Inc., Hoquiam, Wash.

[21] Appl. No.: 776,140

[22] Filed: Mar. 10, 1977

[51] Int. Cl.[2] ..... B65B 13/32

[52] U.S. Cl. ..... 100/26; 100/32; 100/33 PB; 156/499; 156/510; 226/10; 226/118; 226/152

[58] Field of Search ..... 100/4, 26, 32, 33 PB, 100/25; 226/118, 119, 10, 181, 152; 242/78.7; 156/502, 530, 73.5, 483, 494, 499, 583

[56] References Cited

U.S. PATENT DOCUMENTS

| | | | |
|---|---|---|---|
| 2,575,899 | 11/1951 | Vining | 100/26 |
| 3,137,426 | 6/1964 | Brenneisen | 226/118 |
| 3,179,038 | 4/1965 | MacKenzie | 100/26 |
| 3,269,300 | 8/1966 | Billett | 100/26 |
| 3,327,618 | 6/1967 | Cook | 100/26 |
| 3,489,076 | 1/1970 | Countryman | 100/26 |
| 3,536,430 | 10/1970 | Kurihara | 100/26 |
| 3,691,939 | 9/1972 | Goodley | 100/26 |
| 3,834,643 | 9/1974 | Sauveur | 242/78.7 |

*Primary Examiner*—Billy J. Wilhite
*Attorney, Agent, or Firm*—Seed, Berry, Vernon & Baynham

[57] ABSTRACT

A strapping machine and method for applying flexible, heat sealable straps around objects in which the supply coil of strap and the feed rollers for a strap accumulating compartment are driven by a common rotatable drive for synchronous feeding. A strap feeding unit for feeding flexible strap in which a feed and pinch roller extend through opposed slots which intersect a strap carrying groove which totally confines the strap.

A strap tensioning mechanism in which rough tensioning and final tensioning are achieved by the movement of a single mechanical plate. A cutting and sealing head in which feeding of a new strap around the object can occur simultaneously with the sealing of the previous strap. A track opening mechanism which is operated by components of the sealing and cutting head.

25 Claims, 16 Drawing Figures

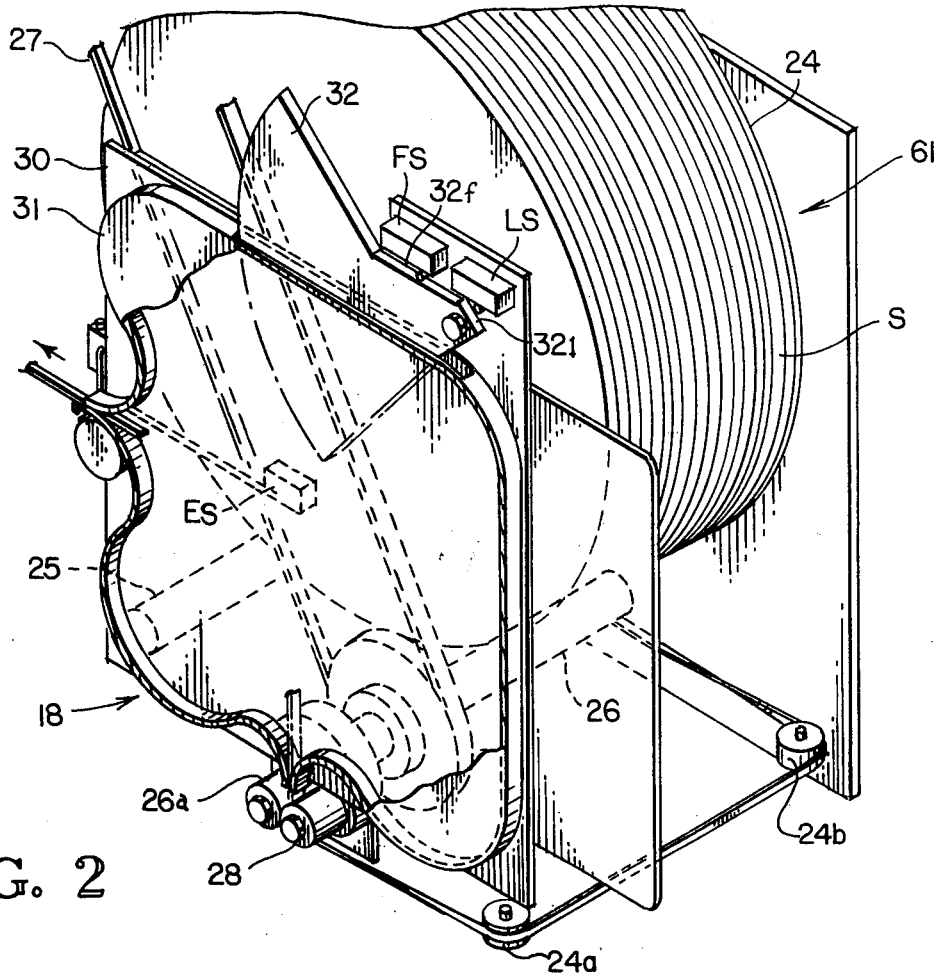
FIG. 2
FIG. 3
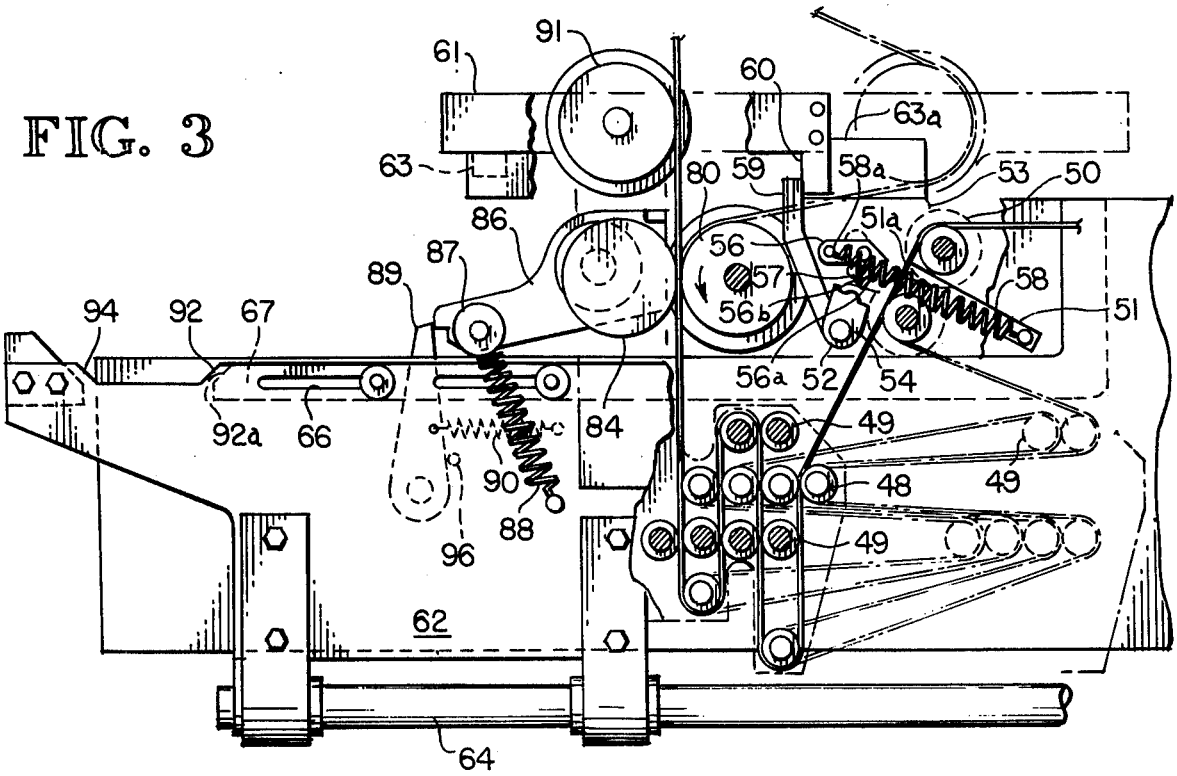

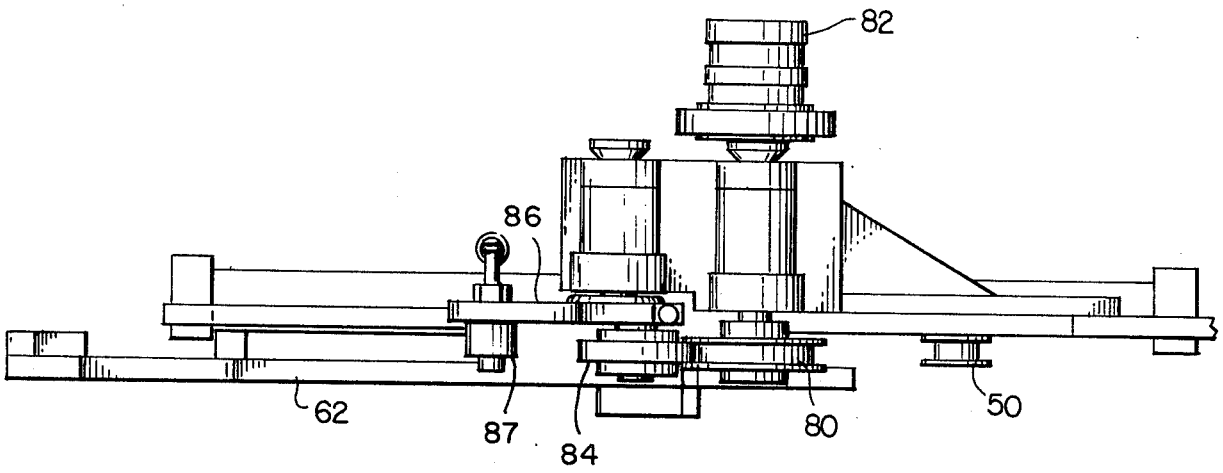
FIG. 4
FIG. 7
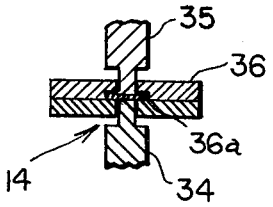
FIG. 5
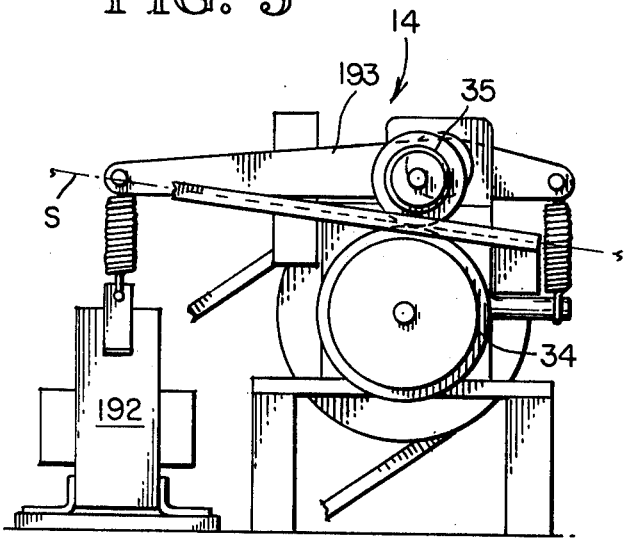
FIG. 6
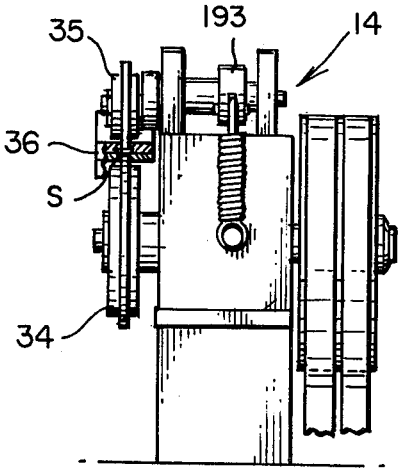

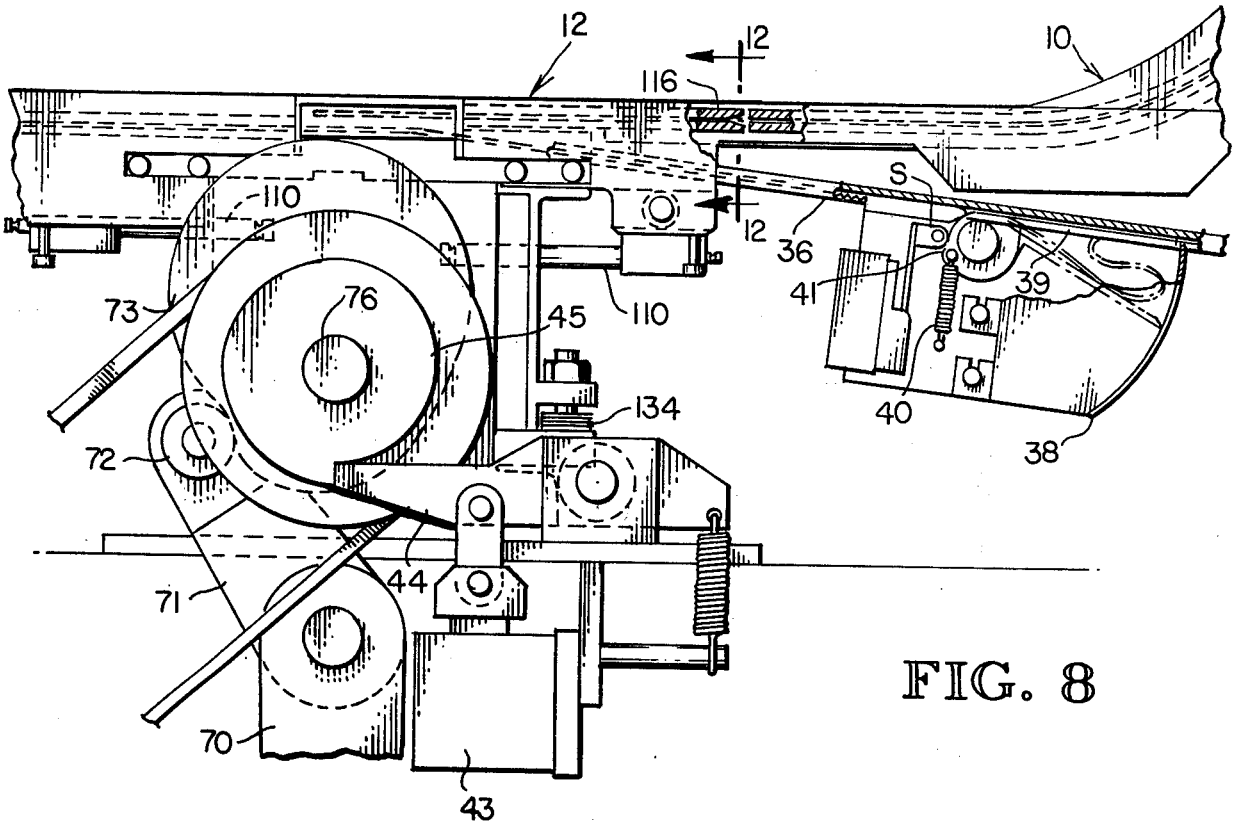
FIG. 8
FIG. 9
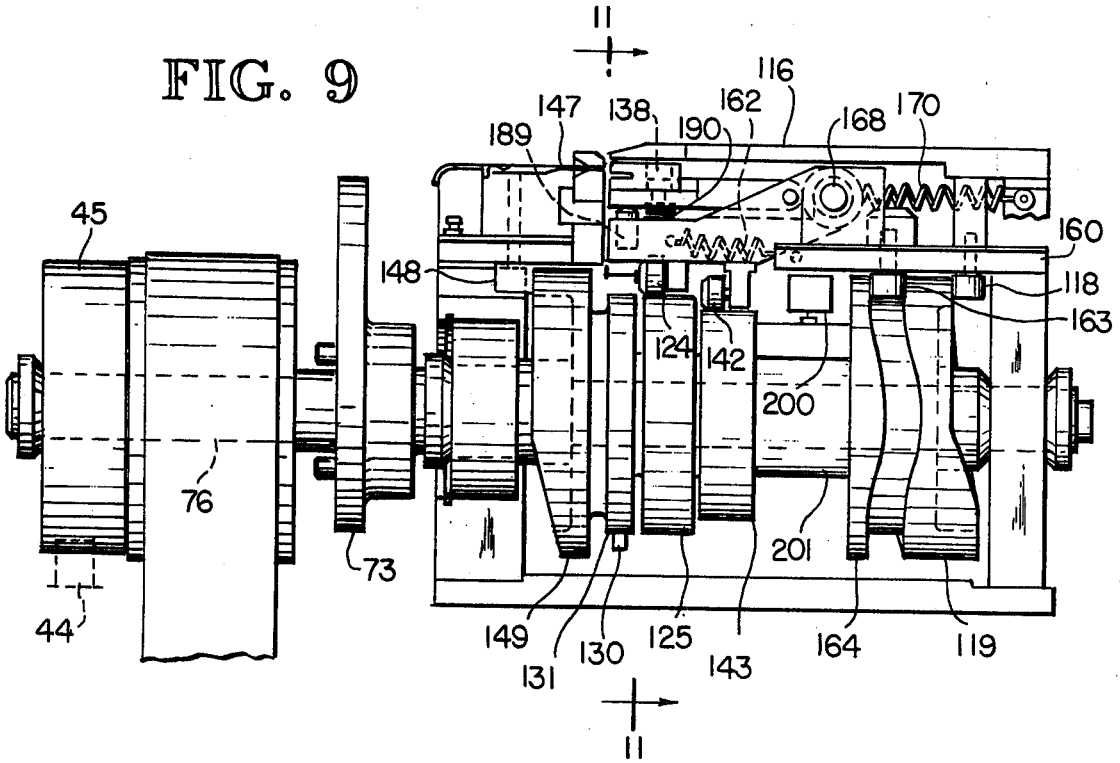

FIG. 10
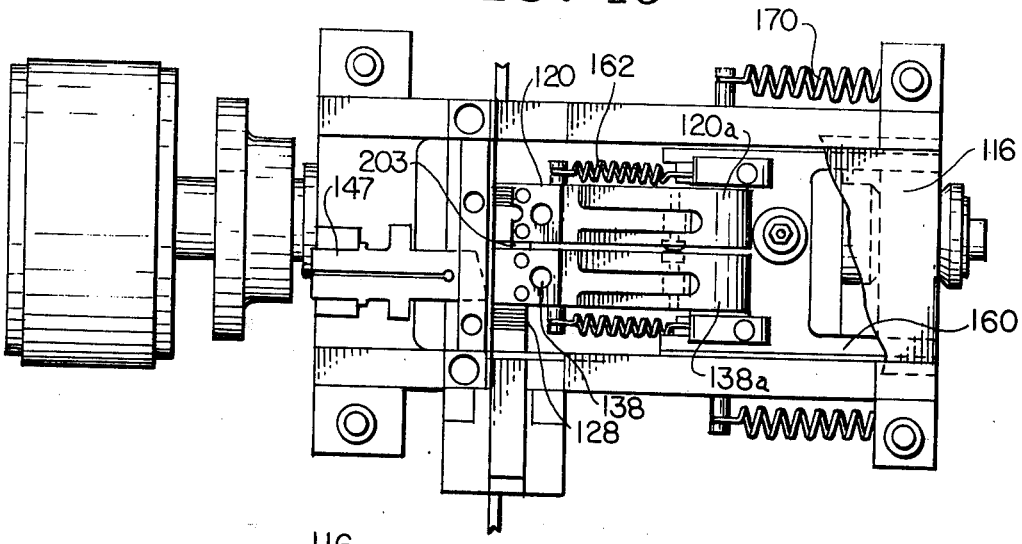
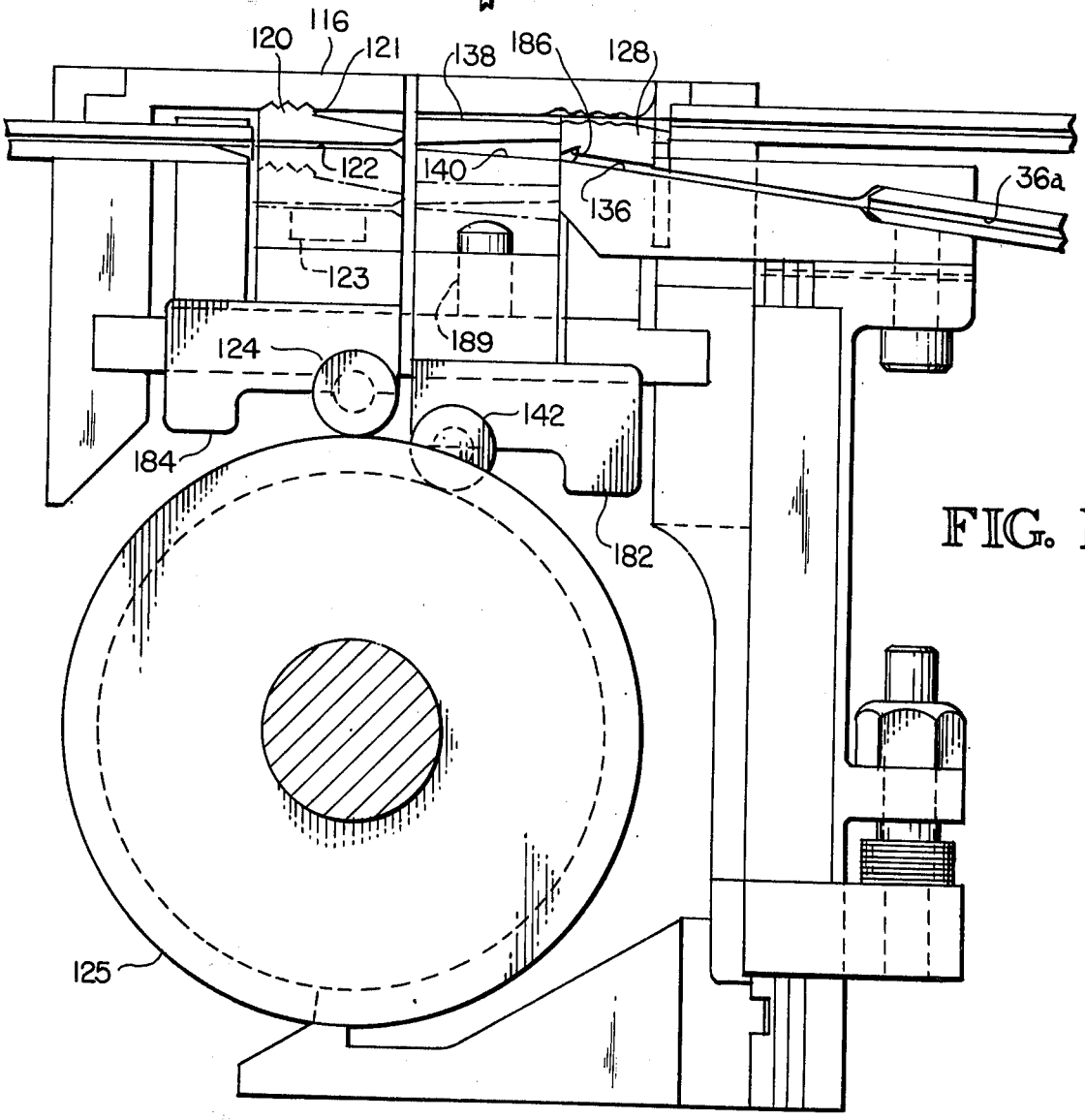
FIG. 11

STRAPPING MACHINE

BACKGROUND OF THE INVENTION

Field of the Invention

This invention pertains to apparatus for wrapping objects with flexible, fusible strap.

SUMMARY OF THE INVENTION

The principal object of the invention is to provide a high speed strapping machine capable of strapping 80 straps a minute as compared to typical known strapping rates of 35 straps a minute. This is accomplished through simple mechanical movements, each combining several functions.

It is another object of this invention to provide an improved flexible strap supply and accumulating device. Basically, this object is obtained by driving the reel or coil of strap for discharging strap synchronously with feed rolls for feeding the discharged strap into an accumulating compartment. In the preferred embodiment this common drive is a single common rotating rod.

Another object of this invention is to provide an improved strap feeding unit for feeding flexible strap in a strapping machine. Basically, this object is obtained by confining the strap in an elongated transverse slot and bringing the powered and pinch rollers together through opposed grooves at right angles to the slot for driving the strap through the slot.

It is another object of this invention to provide an improved strap tensioning mechanism. Basically, this object is obtained by providing first means for pulling the strap around the object with a first tension, providing a second means for drawing the strap tightly around the object at a second, greater tension, and actuating both of these means by a simple mechanical movement of a common plate. In the preferred embodiment the strap is anchored from the supply end until the first predetermined tension is reached, and then the anchor is overcome by the tension in the strap to provide removal of additional strap from the accumulator.

Still another object of the invention is to provide a cutting and sealing head for a strapping apparatus in which a first strap can be sealed while a second strap is simultaneously being positioned around the object. Basically, this object is obtained by providing strap carrying slots in a platen and grippers which are acting on the first strap so that the strap can pass in a parallel path into the track.

Still another object of this invention is to provide an improved track opening device for a strapping apparatus. Preferably this object is obtained by coupling the track opening mechanisms directly to movements of the members in the cutting and sealing heads so that a simple, single operation accomplishes opening of the track.

BRIEF DESCRIPTION OF THE FIGURES OF THE DRAWING

FIG. 2 is an isometric of a preferred strap supply and accumulator.

FIG. 3 is a fragmentary enlarged side elevation of a strap tensioning mechanism.

FIG. 4 is a fragmentary plan of the tensioning mechanism shown in FIG. 3.

FIG. 5 is a side elevation of a strap feeding unit.

FIG. 6 is an end elevation of the strap feeding unit shown in FIG. 5.

FIG. 7 is a fragmentary detail of the strap feeding unit shown in FIG. 6.

FIG. 8 is an enlarged fragmentary front elevation of a cutting and sealing head.

FIG. 9 is an end elevation of the sealing and cutting head and illustrating a common cam shaft control for operating the elements of the cutting and sealing head.

FIG. 10 is a plan of the sealing and cutting head with elements removed for clarity.

FIG.11 is an enlarged detail of the sealing and cutting head taken in a plane parallel to the direction of strap movement.

DETAILED DESCRIPTION OF THE PREFERRED EMBODIMENTS

Figure 1:
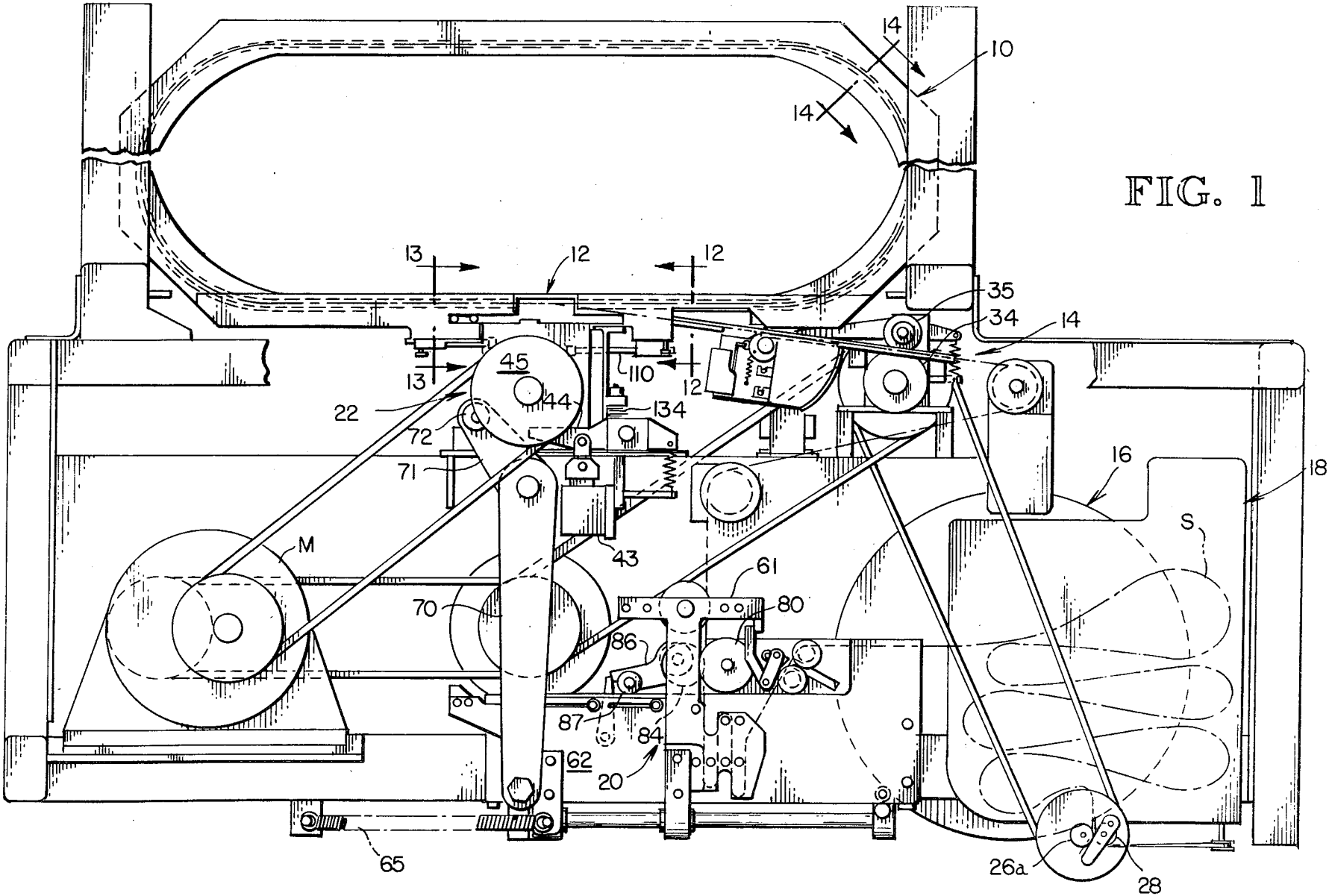
FIG. 1 is a front elevation of a strapping machine embodying the principles of the invention.

As best shown in FIG. 1 the strapping machine includes a strap track 10, a cutting and sealing head 12, a strap feed mechanism 14, a strap supply 16, a strap accumulator 18, a strap tensioning unit 20 and a cam control drive 22. Basically, strap is fed through the strap feed mechanism 14 from the accumulator 18 through the tensioning unit 20. The strap feeds through the cutting and sealing head 12 around the track 10 and the free end of the strap hits an obstruction in the cutting and sealing head to stop its travel. Strap then builds up in the strap feed mechanism signaling to the cam control drive 22 to begin a cycle of sealing, cutting and tensioning. During this cycle the free end of the strap is held while the strap is first roughly tensioned by the tensioning unit 20 to pull the strap out of the track snugly around the object being wrapped. Secondly, the strap is then tightly tensioned around the object and the continuous end of the strap is clamped in the tensioned condition. Next the continuous end which underlies the free end, and the free end are pressed against a heating bar until the strap is melted and then the strap is pressed tightly together with the continuous end severed. After cooling the cutting and sealing head opens so that the strap can be removed with the object and a new cycle of feeding the strap around the track is begun. The machine and the method of strapping objects offer advantages over known prior art machines and methods which advantages will be discussed in more detail during the description of each of the sub-assemblies of the machine.

STRAP SUPPLY AND ACCUMULATOR

The strap supply is best shown in FIGS. 1 and 2 and includes a coil 24 containing strap S. The coil rests on a pair of shafts 25 and 26. Shaft 26 is provided with a rubber friction cover beneath the coil and is provided with a larger diameter roller **26*a* at its end. Shaft 26 thus serves as a powered feed roll to pull the strap from the coil via guide or turning rollers 24*a* and 24*b* and push it into the accumulator 18. Shaft 26 is driven by a belt and pulley drive 27. A pinch roller 28 is spring-mounted to press against the powered roller 26*a***.

The accumulator 18 includes a back plate 30 and a closely spaced clear plastic front plate 31 which forms a housing for the strap. The strap is pushed upwardly into the housing in accordion folds as best shown in FIG. 1. A paddle 32 is pivotally mounted and protrudes down into the top of the housing. The paddle has a low switch operator surface 321 and a full switch operator surface 32*f*. As the accordion folds build up in the housing the paddle is raised until surface 32*f* closes a full switch FS to stop the feed. As strap leaves the accumulator the level of the folds drops deactivating the full switch and when the level drops sufficiently so that surface 321 energizes low switch LS the feed roller 26*a* is again put into motion to increase the supply of strap within the accumulator. An empty switch ES wil stop the machine if strap no longer is available due to an emtpy coil 24.

In known plastic strap supplies and accumulators the feed rolls for the accumulator pull the strap from the coil by pulling directly on the strap. A brake is then used to stop the freely rotating coil. Using this technique the payoff speed is limited because the snap in the strap accelerates the coil and the coast of the coil reel at the end of feeding makes the braking action very critical. In the instant application the feed rolls for driving the coil and feeding the strap are advantageously very simple and require no separate brake for the coil. The drive on the powered shaft 26 operates through a clutch which brings the coil up to speed slowly and the coast at the end of feeding is not a concern since it merely adds a slight amount of additional strap to the accumulator. Using this unique technique the strapping machine is able to be run at higher speeds than in known strapping machines. A further advantage is that with known strap supplies a separate reel is needed to hold the coil whereas in the supply and accumulator of this invention the coil is merely set directly on the supporting shafts 25 and 26. Still further the strap leaves the coil at a constant linear speed regardless of changes in diameter of the roll.

STRAP FEED MECHANISM

The strap feed mechanism 14 is best shown in FIGS. 1 and 8. The feed mechanism includes a continuously rotating powered roller 34 which rotates in a counterclockwise direction. A spring pinch roller 35 actuated by solenoid 192 presses the strap against the powered roller. The rollers 34 and 35 push the strap along a guide channel 36. As best shown in FIG. 7 the guide channel is provided with a slot 36*a* and the peripheral surfaces of the rolls 34 and 35 are of reduced thickness which is less than the width of the slot 36*a*. The strap is thus contained at all times and is supported against buckling as it is driven by the rollers through the channel 36. This is an advantageous feature as buckling of the strap has been a problem with known strap-feeding mechanisms. Known strap-feeding mechanisms generally interrupt the strap guide or channel by breaking the channel upstream and downstream of the feed rollers. This necessitates chamfering the inlet to the downstream end of the track as the strap is fed from the feed rollers. It is in this area of the chamfer, however, where resistance to the movement of the strap causes the tendency to buckle. As is readily apparent in the instant invention of this application there is no chamfer nor interruption of the channel so that the buckling does not occur.

The strap feed mechanism 14 also includes a compartment 38 having a paddle 39 that forms a portion of the channel 36 as it passes over the compartment. The paddle is pivotally mounted and held by a light spring 40 in the raised position. The paddle is provided with a cam 41 that engages a stop switch S. As strap is fed by the rollers 34 and 35 through the channel 36 the free end of the strap passes through the cutting and sealing head 12 around the track 10 and comes to rest again in the cutting and sealing head. When the free end of the strap is blocked the continuous end in the channel 36 begins to back up pushing the paddle 39 downwardly and activating the strap switch S. This de-energizes the solenoid 192 and allows a spring to move the pinch roller 35 away from the powered roller 34 to discontinue feeding of the strap and energizes a trigger solenoid 43 (FIG. 1) which pulls a trigger 44 away from a single revolution clutch 45 which is the basic drive component for the cam control drive 22 to begin the rest of the cycling of the machine.

TENSIONING UNIT

The tensioning unit 20 is best shown in FIGS. 1, 3 and 4 and includes a plurality of freely rotating stationary take-up rolls 48 alternated with freely rotating movable take-up rolls 49. The strap feeds up and down the rolls 48 and 49 as shown in FIG. 3 and when the movable rolls 49 are shifted to the phantom line position in FIG. 3 it can be seen that a considerable amount of strap can be pulled back from the track 10 at the downstream end of the strap. The take-up rolls provide a rough or large retraction of the strap to pull it out of the track 10 and snugly around the object being wrapped. At this time, of course, the free end of the strap is clamped at the cutting and sealing head so that only the continuous end is retracted by the take-up rolls. The strap between the take-up rolls and the accumulator passes over a pair of flanged rollers 50 in between which is fastened an anvil 51. The anvil has a smooth end surface 51*a*. A pair of spaced anchor arms 52 are pivoted on a plate 53 by pivot post 54. Pivotally mounted between the anchor arms is an anchor block 56 having a protruding wedge 56*a*. The anchor block has a surface 56*b* that rides against a pin 57. A spring 58 connects to the anchor arms at a point 58*a* and pulls the arms toward the anvil to pull the wedge 56*a* against the strap and press it against the smooth end surface 51*a* of the anvil. The strap is thus trapped and unable to move from the accumulator during rough tensioning. As the strap is drawn tight on the package, however, the tension increases so that the anchor block begins to rotate relative to the anchor arms and overcomes the force of the spring 58*a*. When the tension reaches a preset desired amount the anchor block swings over-center relative to the spring away from the strap and anvil. This frees the strap for movement from the accumulator as the rollers 49 continue to move toward the right. The anchor arms are fixed to a lever 59 that is engaged by a shoulder 60 that forms part of a T-shaped frame 61. The T-shaped frame is attached to a movable front plate 62 which carries the movable rollers 49 and reciprocates from left to right as shown in FIGS. 1 and 3. When the front plate 62 is to the left the lever 59 is rocked counterclockwise so that the anchor block is freed from the tape. As the front plate moves to the right, however, the spring 58 pulls the anchor arms 52 toward the anvil to bring the anchor block into engagement with the strap.

The front plate 62 slides on ways 64 and is pulled to the left by a spring 65 (FIG. 1). The upper end of the plate is supported by a roller 63 running in a slot in a fixed bar 63*a*. The front plate is coupled to a tension arm 70 that is coupled to a bell crank 71. The free end of the bell crank is provided with a cam follower 72 that follows a cam 73 which is fixed to a cam shaft 76 that is coupled to the single revolution clutch 45. Thus the tension arm begins to swing the front plate 62 to the right when the single revolution clutch is energized after the free end of the strap has completely encircled the object and has come to rest within the cutting and sealing head.

Spaced just above the front plate 62 is a knurled tension roller 80 that is coupled to a slip clutch 82 (FIG. 4) such that the roller 80 is free in the counterclockwise direction as shown in FIG. 1 but will engage the clutch 82 when rotated clockwise and provide a drag to a predetermined desired amount. The strap is pinched against the tension roller 80 by an eccentrically mounted pinch roller 84. The pinch roller is connected to a tension lever 86 having a cam follower roller 87. The lever is pulled down by a spring 88. As the front plate 62 moves to the right during a tensioning cycle the cam roller 87 riding on the top of the plate keeps the pinch roller 84 away from the flanged tension roller 80 so that the strap can be freely drawn back by the rollers 49. The top surface of the plate 62 has a downward ramp 92 and an upward ramp 94. When the front plate moves to the right a distance sufficient to allow the roller 87 to move past the downward ramp 92 the tension lever 86 swings counterclockwise to engage the pinch roller 84 against the tension roller 80. The strap is also pushed to the right (FIG. 3) by a roller which rotates on the movable frame 61 until the tension reaches the desired load on the slip clutch 82 and allows the strap to rotate the roller 80. Continued movement of the front plate 62 to the right draws the roller up the up ramp 94 allowing the dog 89 to seat beneath the notch at the end of the tension lever to hold the tension lever up and in an inactive position away from ramp 92 as the front plate is returned. When the front plate is returned to the left a pin 96 engages the dog 89 to release the tension levers so that the roller 87 returns to the top surface of the front plate 62. An adjustment bar 67 is connected to plate 62 by screws and can be moved to the left to overlap ramp 92 with a second ramp 92*a* thus changing the starting time of the final tensioning.

Known strapping machines usually employ two tensioning devices. The first draws the strap around the package more or less loosely. The second comes into action and draws the strap up to its final tension. In the instant application the invention performs both of these operations by a single mechanism requiring only a single timing sequence. This advantageously results in simplicity of manufacture and operation and greater strapping and tensioning speeds.

CUTTING AND SEALING HEAD

As best shown in FIGS. 1 and 8–14 the cutting and sealing head 12 is provided approximately centrally in the lower run of track 10 and forms a part thereof. The track includes a rectangular plastic strip 100 having a groove 102 for receiving the strap. The track is abutted against a cover 104 by springs 105. The track is mounted on a pad 106 which slides on posts 107. Stripper pins 108 pass through the track and pass into the groove 102 as the track and pads are moved away from the cover. Thus the stripper pins eject the strap from the track groove to prevent binding. The track pads are connected to track bars 110 which are engaged by paddles 182 and 184 to be described to open the track during the desired timing sequence of the strapping cycle.

Figure 12:
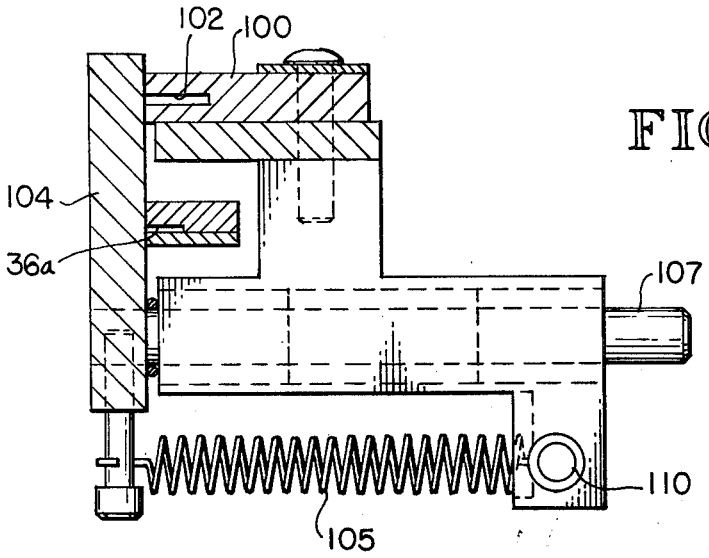
FIG. 12 is a section of the track taken along line 12—12 of FIG. 1.
Figure 13:
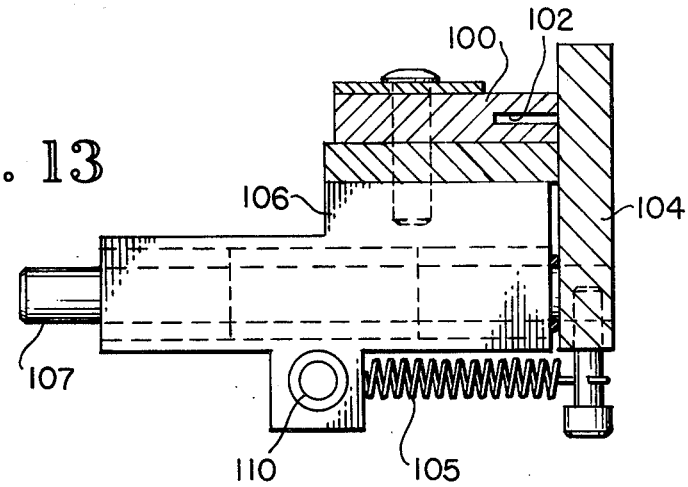
FIG. 13 is a section of the track taken along line 13—13 of FIG. 1.
Figure 14:
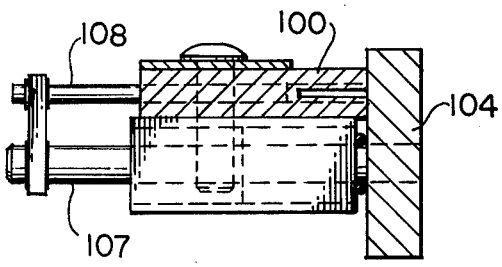
FIG. 14 is a section of the track taken along line 14—14 of FIG. 1.
Figure 15:
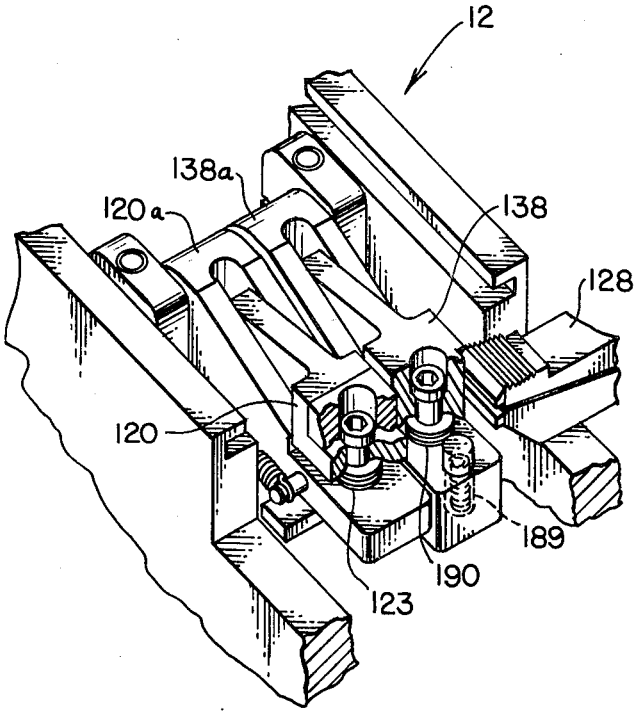
FIG. 15 is a fragmentary perspective of part of the cutting and sealing head.
Figure 16:
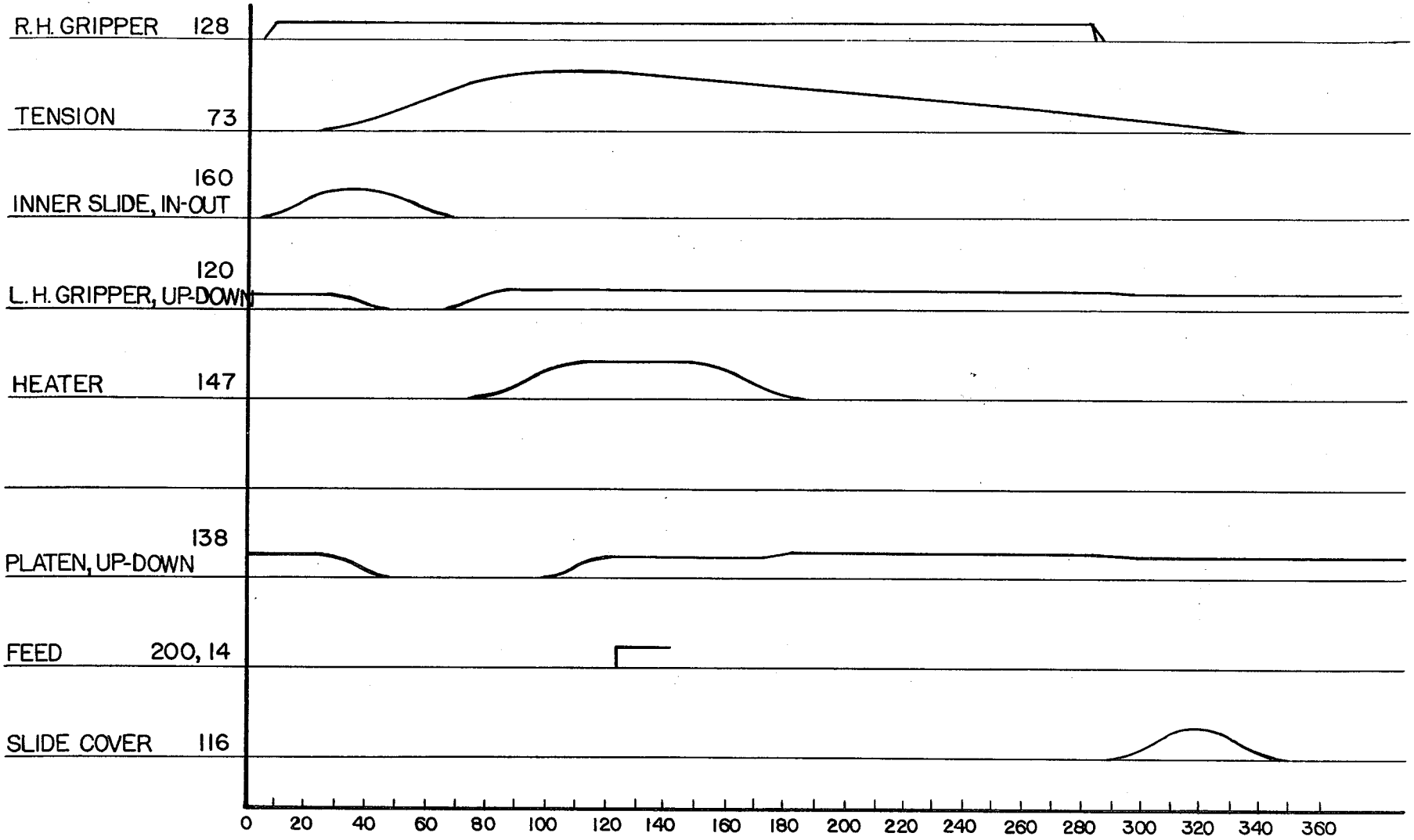
FIG. 16 is a schematic cam timing sequence.

The sections of track immediately adjacent the cutting and sealing head 12 are best shown in FIGS. 12–14. FIG. 12 which is taken along the line 12—12 of FIG. 1 shows the groove 102. FIG. 12 also shows groove 36*a* below the groove 102. This second groove is to allow the continuous strap to move in beneath the captured free end of the strap and for beginning the threading of a new strap during the sealing cycle. FIG. 13 illustrates only the groove 102 since at this location along the track there is only a single groove as the free end of the strap is stopped in the cutting and sealing head.

The cutting and sealing head 12 is provided with a cover plate 116 that is movable transversely of the direction of strap movement. For clarity movements described as being transverse hereinafter will mean transverse to the path of the strap. Also in FIG. 10 which is a plan view of the cutting and sealing head it should be understood that the cover plate 116 has been removed for clarity. The cover plate forms an anvil for gripping and sealing the strap as will be described. The cover plate 116 is reciprocated by a cam follower 118 which rides on a cover plate cam 119. A left hand gripper 120 pivotally mounted in a left hand yoke 120*a* which is pivotally mounted for vertical movement between an upper position as shown in FIG. 11 where it can clamp the continuous end of the strap to the cover plate. The left hand gripper is movable into a lower position as shown in phantom lines in which the free end of the strap engages a stop surface 121 to stop the strap as it makes a loop around the track 10. The left hand gripper is provided with a track groove 122 which allows feeding of new strap while the gripper 120 is raised holding the previous loop of strap. The left hand gripper is free to move downwardly and is held in its raised position by a cam follower 124 that rides on a left hand cam 125. A spring 123 buffers the force between the gripper and the gripper yoke.

A right hand gripper 128 is vertically reciprocally mounted and is moved down by a cam follower 130 that rides on a right hand gripper cam 131. The cam follower 130 pulls the right hand gripper down against the force of a set of Belleville springs 134. These springs when allowed to push the right hand gripper up press the gripper teeth of the right hand gripper against the strap to anchor the free end of the strap against the cover plate 116. The right hand gripper is provided with a track groove 136 which provides a lower path for the strap as the free end of the strap passes between the cover plate and the upper surface of the right hand gripper on its way to the stop surface 121 on the left hand gripper.

A platen 138 is pivotally mounted on a platen yoke 138*a*. The platen yoke is pivotally mounted for movement between the left hand and right hand grippers and between an upper position as shown in solid lines in FIG. 11 in which it presses the lower continuous end of the strap against the upper free end of the strap and against the stop plate 116 to squeeze the straps together after melting. The platen is provided with a lower groove 140 for allowing the continuous end of the strap to be moved beneath the sealed loop of strap for starting a new feeding cycle. A cam follower 142 follows a platen cam 143 to move the platen upwardly from the phantom line lower position to the solid line position shown in FIG. 11. A spring 189 presses the platen with a small force during heating and Belleville springs 190 press the platen with a greater force for bonding the melted ends.

A heater bar 147 is mounted for transverse movement by a cam follower 148 that follows a heater bar cam 149. The heater bar moves between the two runs of strap and melts the strap as the platen presses the straps together by spring 189 and then is removed prior to final pressing of the straps together by the platen through springs 190. The left hand gripper yoke 120*a* and the platen yoke 138*a* are pivotally mounted on an innerslide 160 that is reciprocally mounted for transverse movement. Springs 162 urge the left hand gripper and platen to seat against their respective yokes. The inner slide is reciprocated by a follower 163 that rides between cam surfaces on an inner slide cam 164 and the back of cover plate cam 119. Thus while the platen and left hand gripper can move up and down they also are moved transversely by the inner slide. Springs 170 move the cover plate to the left and the cam follower 118 moves it transversely to the right.

OPERATION

The operation of the cutting and sealing head 12 is best described with a complete overall operation of the machine. In the start condition the strap S has been loaded in the machine and fed around the track 10. The main drive motor M is running. The position of all elements of the machine are shown as in the drawings. At a signal to apply a strap the trigger solenoid 43 energizes and pulls the trigger away from the single revolution clutch 45. This releases the clutch and engages the drive with a cam shaft 180 on which all of the various cams are mounted. The cam shaft begins to rotate and releases the right hand gripper 128. The right hand gripper is driven upward by the Belleville springs 134 and anchors the free end of the strap (in from its terminal edge) against the cover plate 116. Continued rotation of the cam shaft causes the inner slide 160 to move transversely to the right away from the strap. Since the platen 138 and the left hand gripper 120 are mounted on the inner slide they also are pulled away from the strap to clear the strap area for tensioning. The retraction of the inner slide also opens the strap guide track 10. This occurs by paddles 182 and 184 which are on the platen and left hand gripper, respectively, and which engage the track bars 110. Motion of the track pads 106 causes the stripper pins 108 to push the strap free of the track groove 102. Once the platen and left hand gripper are clear of the strap and the track is open the tension cam 73 drives the tension arm 70 in a counterclockwise direction (as viewed in FIG. 1) and pushes the front plate 62 to the right to begin tensioning.

The first motion of the front plate allows the anchor block 56 to be swung down and clamp the strap to the anvil 51. Continued motion of the front plate 62 causes the strap to be drawn from the track down on the package. The strap is drawn by the alternate sets of moving and fixed rollers 49 and 48. When the strap is around the package and no more strap can be drawn from the track the tension in the strap increases and trips the anchor which releases and allows the strap to be drawn from the accumulator so that the front plate can complete its stroke. Toward the end of the front plate movement the tension lever roller 86 falls down the ramp 92 and allows the tension rolls 84 and 80 to close on the strap. The strap is then drawn to the final tension by the remainder of the front plate movement.

At the beginning of the tensioning, after the inner slide is retracted, the left hand gripper 120 and the platen 138 drop downward in response to the platen and left hand gripper cams. Near the end of tensioning, the inner slide 160 moves back to its initial position. During this motion the platen and left hand gripper, now in the lower position, come back underneath the just tensioned strap. This motion also allows the track to close. Thus at this moment the continuous run of the strap is confronting the trapped free end of the strap. The left hand gripper is then raised to the up position by its cam and clamps the continuous end of the strap against the cover plate.

At the end of the tension front plate 62 movement the tension lever 86 rolls up the ramp 94 and separates the tension rollers 80 and 84. Just as the left hand gripper comes up to press the strap against the cover plate and thus against the underside of the free end of the strap the heater blade 147 moves in between the straps at the seal area. Once the heater blade is in place the platen 138 rises to an intermediate position and presses against the strap by the spring 189. During this time a cutter 186 on the surface of the right hand gripper 128 shears the continuous end of the strap to separate it from the supply. At the intermediate position the platen presses the bottom strap, heater and top strap together so that the strap is melted for sealing. The press force is determined by a spring and plunger between the platen and the platen lever which is pivoted on the axis 168.

At this time a switch 200 is actuated by cam 201. The activation of this switch energizes a feed solenoid 192 that draws the pinch roller 35 against the powered feed roller 34 by a lever 193. Because the strap is pressed between the rolls it is fed and passes through the channel 36, the groove 112 in track 10, the groove 136 in right hand gripper 128, the groove 140 in platen 138, the groove 122 in the left hand gripper 120, the groove 102 in the track 110 as it leaves the cutting and sealing head.

When the melting of the strap is complete the heater blade is pulled back by the heater cam 149. When the heater bar is clear of the strap the platen cam 143 drives the platen up hard against the overlapping ends of the straps and presses the melted sections together. The Belleville springs 190 between the platen and the platen lever overcome the spring 189 and determine the pressing force. These springs 190 do not affect the heating force from spring 189, however, since they do not contact the bottom of the platen until the cam forces the platen up into its final press. After the melted plastic has hardened the left hand gripper 120, the platen 138, and the right hand gripper 128 move down to their initial positions in response to their respective cams. After the grippers and platen have started down the cover plate 116 is retracted by its cam 119 against the force of springs 170 to allow the sealed strap to leave the sealing head. The cover plate immediately returns to the initial position after the strap is free.

After the tensioning part of the cycle the front tension plate 62 is returned by its cam 73 so that at the end of the cam shaft rotation the front plate is back to its initial position and has moved the dog 89 out from under the tension lever 86 and has retracted the anchor block 56. Ready for the next cycle. At the end of the cam shaft rotation the trigger 44 engages the single revolution clutch 45 which then disconnects the drive from the cam shaft.

Just after the cover plate 116 closes, the end of the new feeding strap enters the sealing head and strikes the stop surface 121. Feeding then stops when the strap backs up into the compartment 38. This completes the cycle of operation.

Known strapping machines start the strap feeding part of the cycle only after the seal has been made and after the strap has been ejected from the machine. As described above, in the invention of this application feeding of the new strap occurs during the sealing operation thus shortening the total cycle time. Known strapping machines also use separate actuators such as air cylinders or solenoids to provide the opening force for the track. In the invention of this application the motion of the gripper and platen in the sealing and cutting unit provide this opening force and is much simpler in construction and operation and far more reliable. Known strapping machines rely on the lateral stiffness of the strap to keep the straps aligned with each other in the seal area. Since the slides and guides employed in known stapping machines and always the heater blade are moving sideways relative to the strap, there is a tendency in the known strapping machines for the straps to be moved out of alignment thus producing misaligned seals. In the invention of this application a stripper bar 203 is advantageously provided to keep the two straps aligned rather than solely relying on lateral stiffness of the strap. In known strapping machines the gripper for holding the free end of the strap prior to tensioning is generally done either by separate triggering mechanisms such as cylinders or solenoid or by the technique of coupling the gripper with motion of the seal head then stopping the head for tensioning and finally restarting the head to complete the seal after tensioning is complete. In the invention of this application the initial gripper is applied, tensioning and sealing are all accomplished with one revolution of a cam shaft giving simplicity, reliability and a very high speed machine.

While the preferred embodiment of the invention has been illustrated and described and the known advantages apparent have been discussed, it should be understood that variations and other advantages will be apparent to one skilled in the art without departing from the principles herein. Accordingly the invention is not to be limited to the specific embodiment illustrated in the drawings.

We claim:

1. A strap supply and accumulating apparatus for flexible strapping machines comprising:

means for supporting a coil of strap for rotation about an axis of rotation, coil drive means for directly engaging the strap on the peripheral surface of the coil for rotating said coil, an accumulating compartment having an inlet and an outlet, feed roll means located at said compartment inlet for moving strap into said inlet, means coupling said coil drive means to said feed roll means for substantially synchronous rotation of the feed roll means and coil drive means whereby the linear speed of the strap leaving the coil and the linear speed of the strap passing through the feed roll means are approximately equal during all strap movements, and means for controlling said coil drive and feed roll means for varying the quantity of strap fed into said accumulating compartment.

2. The apparatus of claim 1, said coil supporting means including a first rod parallel to the coil axis of rotation for supporting the peripheral surface of the coil and also forming said coil drive means, and including a second rod freely rotatably mounted for rotation about an axis below and parallel to said coil axis, said feed roll means including an axial extension of said first coil supporting rod.

3. The apparatus of claim 2, said axial extension of said first coil supporting rod having a diameter slightly greater than the coil supporting portion of the rod for producing tension on the strap as it is pulled off the coil.

4. The apparatus of claim 1, said feed roll means having a constant speed slightly greater than said coil drive means for imparting a slight tension on the strap leaving the coil.

5. The apparatus of claim 1, said coil drive means and said feed roll means including a common shaft for synchronizing the rotation between the coil drive means and feed roll means.

6. The apparatus of claim 5, said feed roll means including a feed roll on said shaft of a diameter such that the linear speed of the strap at the feed roll is slightly greater than at the coil periphery so that a slight tension is applied on the strap leaving the coil.

7. A strap feeding unit for feeding flexible strap in a strapping machine, comprising:

a track guide having a transverse strap carrying groove and opposed slots at right angles to said strap carrying groove, a feed roller located on one side of said track guide and having a peripheral surface extending into said groove through one of the slots, a pinch roller located on the opposite side of said track guide and having a peripheral surface extending into said groove through the opposite slot, said slots having a transverse width less than the width of said groove so that the strap is confined top, bottom and at its side edges by the groove at the location of the feed and pinch rollers, means for rotating the feed roller, and means for pushing the rollers together for pushing strap along the groove.

8. In a machine for applying a flexible strap around an object, a strap tensioning mechanism comprising:

first means for pulling a loop of strap around the object with a first tension, second means for pulling the loop of strap more tightly around the object with a second tension greater than said first tension, and mechanical control means for actuating said first and second strap pulling means in numerical sequence, said control means including a movable member commonly driving both said first and second pulling means in said numerical sequence.

9. The strap tensioning mechanism of claim 8, said movable member including an elongated plate, said first pulling means including a plurality of stationary strap engaging rollers, and a plurality of movable strap engaging rollers secured to said plate for movement relative to said stationary rollers, the strap being alternately engaged by both sets of rollers so that movement of said plate will extend the length of strap wrapped around the rollers.

10. The strap tensioning mechanism of claim 8, said movable member including an elongated plate, said plate having a cam surface, said second strap pulling means including a tensioning roller, mounted for free rotation in one direction only, slip clutch means for allowing rotation of the tensioning roller at a frictional load when said second tension is reached, pinch roller means for pressing the strap against the tensioning roller, means engagable with said cam surface on said plate for actuating said pinch roller for operatively engaging and releasing the strap, and roller means on said plate for moving the strap to draw strap to said second tension by pulling against said frictional load on said tension roller.

11. The strap tensioning mechanism of claim 10, said first pulling means including a plurality of stationary strap engaging rollers, a plurality of movable strap engaging rollers secured to said movable plate for movement relative to said stationary rollers, the strap being alternately engaged by both sets of rollers so that movement of said movable rollers will extend the length of strap wrapped around said rollers, first anchoring means for holding the free end of the strap, second anchoring means for holding the strap toward the supply end of the strap, and means for releasing the supply end strap anchoring means when said first tension is reached in the strap for allowing additional movement of said movable rollers to draw strap from the supply.

12. The strap tensioning mechanism of claim 8, including first means to anchor the free end of the strap, a supply, second means for anchoring the strap from the supply, said control means being operative to engage said second anchoring means prior to tensioning so that strap is pulled only around the object, and said second anchoring means including release means for freeing the strap from the supply when said first tension is reached in the strap, said second anchoring means including an anvil, an anchor member, an anchor arm pivotally and resiliently carrying the anchor member toward and away from said anvil, and said release means including a resilient pivot connection in which movement of the anchor member against the strap and anvil will hold the strap until the tension in the strap reaches said first tension and then pulls the anchor member with the strap past the anvil so that the anchor member moves in the direction of strap movement and releases the strap.

13. In a machine for applying flexible sealable strapping to an object, and having means for feeding strap through a track around the object in a loop in a cutting and sealing plane, tensioning the strap tight on the object, cutting the supply end of the strap and sealing the free end and supply end of the strap together, the improvement comprising:

a cutting and sealing head in the cutting and sealing plane of said track, including means for gripping the two ends of the strap, means for sealing the two ends together, and means for freeing the sealed ends for removal of the strapped object all in said same cutting and sealing plane, and means for feeding a new strap beneath the cutting and sealing head and in said cutting and sealing plane around the object while the previous strap is being sealed in said cutting and sealing plane.

14. In a machine for applying flexible sealable strapping to an object, and having means for feeding strap through a track around the object, tensioning the strap tight on the object, cutting the supply end of the strap and sealing the free end and supply end of the strap together, the improvement comprising:

a cutting and sealing head, including means for gripping the two ends of the strap, means for sealing the two ends together, means for freeing the sealed ends for removal of the strapped object, and means for feeding a new strap around the object while the previous strap is being sealed, said gripping means including a cover plate, a first gripper engagable with the cover plate to anchor the free end of the strap, second gripper means engagable with the cover plate to anchor the supply end of the strap in overlying relation to the free end of the strap, sealing means for melting the strap ends for sealing, and platen means engagable with the cover plate for pressing the melted strap ends together, said means for feeding a new strap while the previous strap is being sealed including strap guiding slots in said first and second gripping means and in said platen means for forming a strap passage generally parallel to the engagement points of the previous strap between the cover plate and the gripping platen means and aligned with said track for guiding the strap along the track during sealing of the previous strap, and means for opening the cover plate to release the previously sealed strap.

15. The machine of claim 14, said cover plate, gripping means and platen means being aligned in a sealing passage in said track, means for moving the supply end gripping means and said platen means laterally out of said sealing passage for moving the new strap supply end into engagement with the new strap free end held against said cover plate, and means for cutting the supply end of the strap by said free end gripping means for forming a closed loop of the new strap joined in said sealing passage.

16. The machine of claim 15, an inner slide, said supply end gripping means and said platen means being pivotally mounted on said inner slide, said means for moving said supply end gripping means and said platen means laterally including means for moving said inner slide laterally.

17. The machine of claim 14, said means for moving the strap melting means, said first and second gripping means and said platen means including a plurality of cams driven from a common cam shaft.

18. A machine for wrapping strap around objects, comprising:

a strapping compartment, a track encircling the strapping compartment, said track including a cover and a strap guiding member having an open ended groove closed by said cover, a cutting and sealing unit positioned within said track for cutting and sealing the cut ends of a strap together, said cutting and sealing head including first and second gripping means for anchoring both ends of the strap, heating means for melting the strap ends, and platen means for pressing the melted ends together, means for moving at least one of said gripping means and said platen means laterally of the track to bring the strap surfaces together, and means coupled to said lateral moving means and said track for simultaneously opening the entire track as a unit by said lateral moving means to free the strap for tensioning around the object.

19. The machine of claim 18, said track being opened as a whole unit by moving said strap guiding member away from said cover, and a plurality of stationary stripper pins axially protruding into said strap guiding member and intersecting said strap groove as the strap guiding member is moved for pushing the strap from said groove.

20. In a machine for applying a flexible strap around an object, a strap tensioning mechanism for tightening the strap along a path between the object and the supply by retracting the strap from the object, comprising:

means for guiding the strap around the object and holding the free end thereof, first means for moving the strap out of said path for pulling the loop of strap around the object with a first tension, anchor means for releasably anchoring the strap between the tensioning mechanism and the supply so that as said first means moves the strap out of the path the strap is held at its free end and the supply thus causing the loop of strap around the object to tighten onto the object, second means for pulling the strap more tightly around the object with a second tension greater than said first tension, said second means including a set of rollers pinching the strap and allowing movement of the strap toward the object at the second tension and only when the second tension is obtained, a second member for moving the strap out of the path between the set of pinching rollers and the object for tightening the strap around the object with said second tension, and means for releasing said anchor means when said first tension is exceeded to release the strap between the pinching rollers and the supply.

21. The apparatus of claim 20, said pinching rollers including a first roller having a slip clutch to allow free movement of the strap toward the supply but restricted movement of the strap at said second tension toward the object.

22. A machine for wrapping straps around objects, comprising:

a strapping compartment, a track encircling the compartment, a cutting and sealing unit positioned along said track for cutting and joining the cut ends of the strap together, the improvement comprising:

said track having an open rigid strap guide member forming a partial loop having an upper portion, a lower portion, and opposed end portions, a closure member having upper, lower and end portions confronting said corresponding portions of the open strap guide for closing the opening to form a closed path for guiding movement of the strap around an object in the compartment, and means for engaging only one of said track guide or closure member portions for moving the entire closure member or track guide as a unit away from its confronting closure member or guide to release the strap from the guide.

23. The machine of claim 22, wherein said track guide is moved away from said closure member.

24. The machine of claim 23, said cutting and sealing unit including a movable element for joining the cut ends, said means for engaging the track guide including link means coupled to said movable element for opening the track guide in response to movement of said movable element of said cutting and sealing unit.

25. The machine of claim 23, including strapper pins extending into said strap guide and passing into the path of the strap and against the strap when the strap guide is moved away from said closure member to push the strap clear of the strap guide.

* * * * *